US008760975B2

(12) United States Patent
Rudaz

(10) Patent No.: US 8,760,975 B2
(45) Date of Patent: Jun. 24, 2014

(54) TIMEPIECE FURNISHED WITH A DEVICE FOR DISPLAYING DETERMINED TIME PERIODS

(75) Inventor: Denis Rudaz, Prévessin-Moëns (FR)

(73) Assignee: Rolex S.A., Geneva (CH)

( * ) Notice: Subject to any disclaimer, the term of this patent is extended or adjusted under 35 U.S.C. 154(b) by 481 days.

(21) Appl. No.: 13/227,736

(22) Filed: Sep. 8, 2011

(65) Prior Publication Data

US 2012/0057434 A1 Mar. 8, 2012

(30) Foreign Application Priority Data

Sep. 8, 2010 (EP) ..... 10405168

(51) Int. Cl.

| | |
|---|---|
| ***G04B 19/20*** | (2006.01) |
| ***G04B 19/24*** | (2006.01) |
| ***G04B 11/00*** | (2006.01) |
| ***G04B 19/25*** | (2006.01) |
| ***G04B 19/253*** | (2006.01) |

(52) U.S. Cl.

CPC ..... *G04B 11/006* (2013.01); *G04B 19/25* (2013.01); *G04B 19/25373* (2013.01)

USPC ..... 368/28; 368/35; 368/37

(58) Field of Classification Search

CPC .... G04B 11/006; G04B 19/25; G04B 19/253; G04B 19/25373; G04B 19/2538

USPC ..... 368/28, 34–38

See application file for complete search history.

(56) References Cited

U.S. PATENT DOCUMENTS

| | | | | |
|---|---|---|---|---|
| 5,699,321 | A | 12/1997 | Vaucher | |
| 6,118,734 | A * | 9/2000 | Ray et al. | 368/37 |
| 7,158,448 | B1 | 1/2007 | Gabathuler et al. | |

(Continued)

FOREIGN PATENT DOCUMENTS

| | | |
|---|---|---|
| CH | 699102 A2 | 1/2010 |
| EP | 0756217 A1 | 1/1997 |

(Continued)

OTHER PUBLICATIONS

European Search Report (ESR) of European Appl. No. 10405168, Mar. 17, 2011, pp. 1-5.

*Primary Examiner* — Vit W Miska

(74) *Attorney, Agent, or Firm* — Westerman, Hattori, Daniels & Adrian, LLP

(57) ABSTRACT

This device for displaying time periods comprises a display element (A), an indicator component (1), a drive component (3) for driving the indicator component (1), an instantaneous-jump cam (6) engaged with the drive component (3), a drive mobile (5) for driving the cam (6) and correction means (4) for coming into direct engagement with the indicator component (1). A one-way connection device (3*b*, 11, 12) connects the drive mobile (5) to the cam (6). The drive component (3) is engaged with the cam (6) by elastic return means (3*d*) and guidance means (3*b*) defining a degree of freedom of the drive component (3) in order to allow the indicator component (1) to move the drive component (3) against the elastic return means (3*d*) when the latter occupies a position interfering with the movement of the indicator component (1) by the correction means (4).

10 Claims, 6 Drawing Sheets

(56) References Cited

U.S. PATENT DOCUMENTS

| | | | | |
|---|---|---|---|---|
| 2002/0080686 | A1* | 6/2002 | Rochat et al. | 368/37 |
| 2005/0254350 | A1 | 11/2005 | Fleury | |
| 2006/0034157 | A1* | 2/2006 | Charpier | 368/35 |
| 2007/0019507 | A1* | 1/2007 | Gabathuler et al. | 368/28 |
| 2008/0181060 | A1 | 7/2008 | Mahler et al. | |
| 2009/0016169 | A1 | 1/2009 | Villar et al. | |

FOREIGN PATENT DOCUMENTS

| | | | |
|---|---|---|---|
| EP | 1586961 | A2 | 10/2005 |
| EP | 1596261 | A1 | 11/2005 |
| EP | 1734419 | A1 | 12/2006 |
| EP | 1746470 | A1 | 1/2007 |
| EP | 1953611 | A1 | 8/2008 |
| EP | 2015146 | A1 | 1/2009 |

* cited by examiner

TIMEPIECE FURNISHED WITH A DEVICE FOR DISPLAYING DETERMINED TIME PERIODS

The present invention relates to a device for displaying determined time periods comprising a display element for displaying said time periods, an indicator component mounted so as to be able to move relative to said display element, a drive component furnished with a drive finger for driving the indicator component, a cam comprising a progressive winding phase and an instantaneous unwinding phase of a spring, this cam being engaged with said drive component, a drive mobile for driving said cam in a cycle corresponding to that of said time periods and correction means for coming into direct engagement with said indicator component. The invention also relates to a timepiece, notably a watch, furnished with such a device.

The instantaneous-jump calendar mechanisms known in the prior art comprise rapid correction means that can act only by advancing the date, but not by reversing it. This may be appropriate if the calendar is simple. The wearer of the watch will have at most only 30 calendar indicator to advance in order to adjust the date. On the other hand, if the calendar is annual or perpetual, and the only means of correcting it involves the correction of the date, the possibility of being able to drive the calendar indicator by advancing or reversing the date becomes a necessity. However, if it is desired to carry out the rapid correction of the date when the drive mobile is engaged with the tooth gear of the calendar indicator disk, the user is in a blockage situation if he seeks to advance the date, which leads to damaging the mechanism if he seeks to overcome this blockage. If the user seeks to make a rapid correction by reversing the date, once the correction is completed, the spring that actuates the lever and the instantaneous-jump cam restores the accumulated energy at the time of this correction and causes the cam to turn. This rotation of the cam changes the reversal of the calendar indicator disk and causes it to advance one step. These mechanisms therefore comprise periods of time during which the correction of the date is not possible. Moreover, these periods of time when the date cannot be corrected are capable of being amplified if the time is set previously when the drive mobile is engaged with the tooth gear of the calendar indicator disk. Solutions have certainly been proposed for the purpose of removing these periods of noncorrection, but the latter restrict rapid correction to the date-advancing direction only.

EP 1 953 611 A1 and CH 699 102 A2 relate to display mechanisms, notably with trailing date change, having the particular feature of being able to correct the date in both directions by means of the time setting. Thus, the two-directional date correction is carried out only slowly.

EP 2 015 146 A1 relates to an instantaneous-jump display mechanism comprising a cam, incorporated into an instantaneous-jump drive mobile, the geometry of which is designed to disengage the calendar driving finger from the tooth gear of the calendar indicator disk. This solution allows rapid correction of the date in the direction of advancing the date, but does not cancel out the periods of noncorrection of the date in the reverse date direction. Moreover, this solution does not take account of the situation in which, following the change of date, the user would set the time which would return the drive finger of the calendar indicator disk into the tooth gear of this disk and would then prevent a rapid resetting to the date on pain of breakage.

EP 1 746 470 A1 describes a mechanism for displaying calendar indicator which comprises an elastic driving finger of the calendar indicator disk, mounted on an instantaneous-jump drive mobile. This elastic finger makes it possible to remove all the periods of rapid noncorrection of the date in the direction of advancing the date but does not remove the periods of rapid noncorrection of the date in the reverse date direction. Such a solution moreover is not suitable for cancelling the rapid correction of the date in the reverse date direction.

Document EP 1 586 961 A2 relates to a driving mobile with instantaneous jump furnished with a one-way connection between the 24-hour wheel and the calendar driving finger. The sole object of this invention is to remove any risk of breakage when setting the time of a perpetual calendar. The document makes no mention of any problem relating to the rapid correction of the calendar in one or two correction directions, and describes no correction means.

Document EP 1 734 419 A1 describes a design the object of which is to allow the time to be set at any time. No mention is made of means for rapidly correcting the various indicators.

The object of the present invention is to at least partly remedy the abovementioned drawbacks.

Accordingly, the subject of this invention is a device for displaying determined time periods as claimed in claim 1.

Claims 2 to 7 define embodiments of this device.

Claim 8 defines a timepiece according to the invention.

By virtue of this display device, the transition from one determined time period to the next takes place instantaneously without the risk of a double jump. This device allows the indicated time period to be corrected at any time. Depending on the case, it makes it possible to make this correction in the increasing display direction and in the decreasing display direction.

This display device can be used notably both with an annual calendar and with a perpetual calendar without requiring an additional correction button. It could also be used to drive a days of the week indicator or else an hours disk for a jumping hours display watch, or else a mobile for indicating the phases of the moon and would allow, at any time, depending on the case, the rapid two-way correction of these indications.

Other particular features and advantages of the present invention will appear in the course of the following description made, as an example, of two embodiments and one variant, illustrated schematically by the appended figures in which.

In the example illustrated by FIGS. 1 to 7, the device for displaying determined time periods relates to the display of the calendar indicator of a timepiece and therefore corresponds to 24 hours. This device comprises a calendar indicator disk 1 furnished with a tooth 1*a* and positioned by the nose 2*a* of a jumper 2, and a display component A formed by an aperture made in a dial. It also comprises a rapid correction mobile 4, of which the tooth 4*a* is engaged with the tooth 1*a* of the calendar indicator disk 1 and can drive the calendar indicator disk in both directions. This rapid correction mobile can be controlled directly, in a known manner, by the winding mechanism shaft, while being driven not by the timing gear train but by a more direct and therefore more rapid connection, hence the name "rapid correction" in order to distinguish it from the correction using the timing gear train which is slower because of the inherent gearing down of this gear train.

Figure 1:
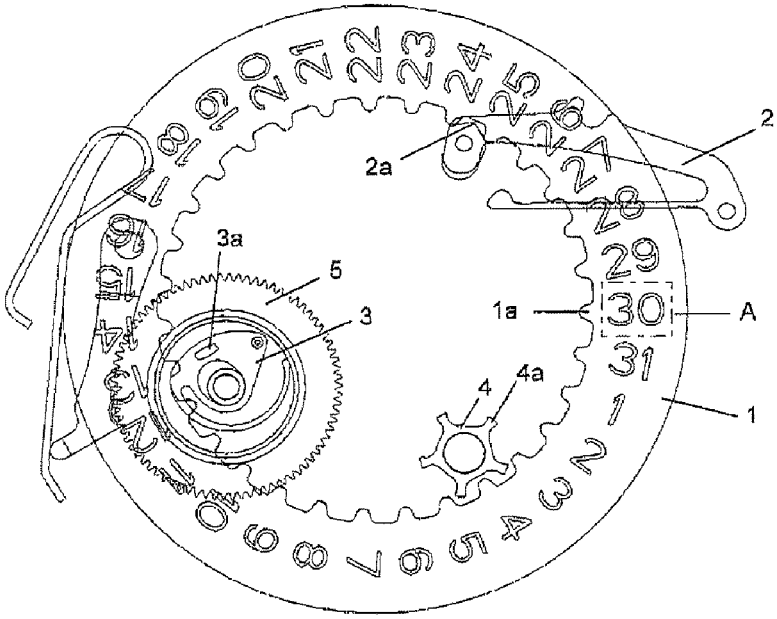
FIG. 1 is a plan view of the first embodiment of the display device.
Figure 1A:
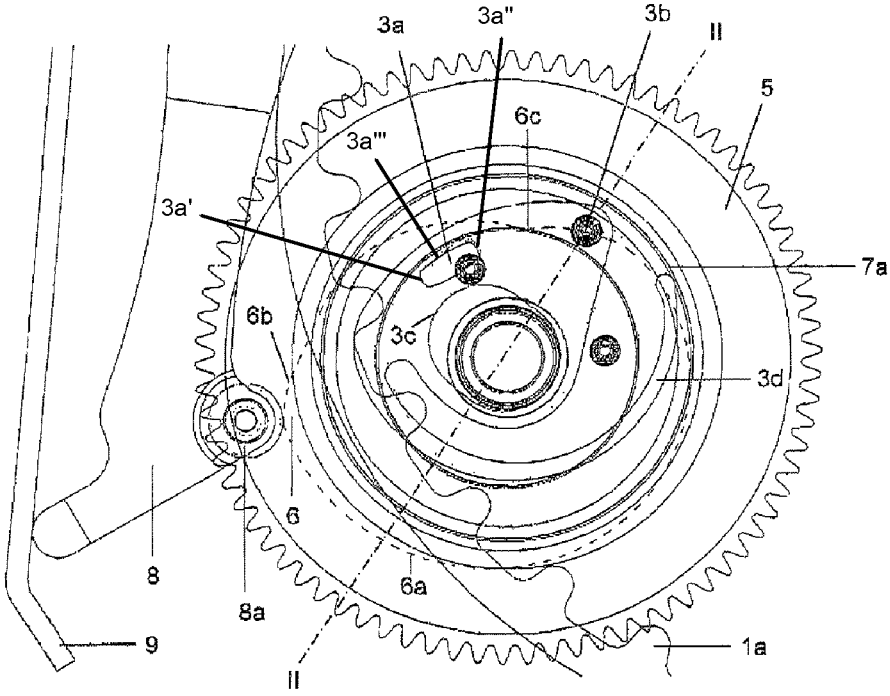
FIG. 1A is an enlarged partial plan view of FIG. 1.
Figure 2:
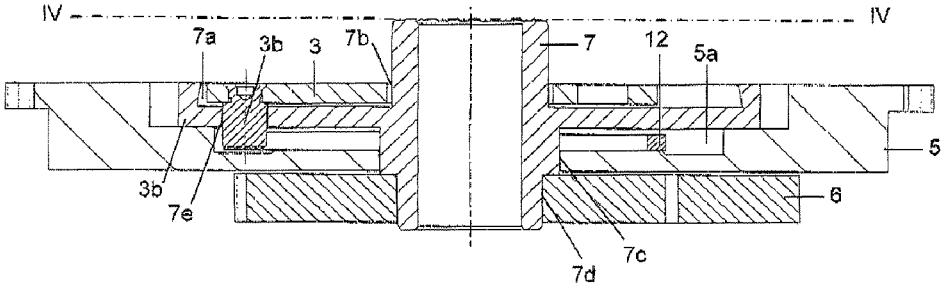
FIG. 2 is a view in section along II-II of FIG. 1A.
Figure 3:
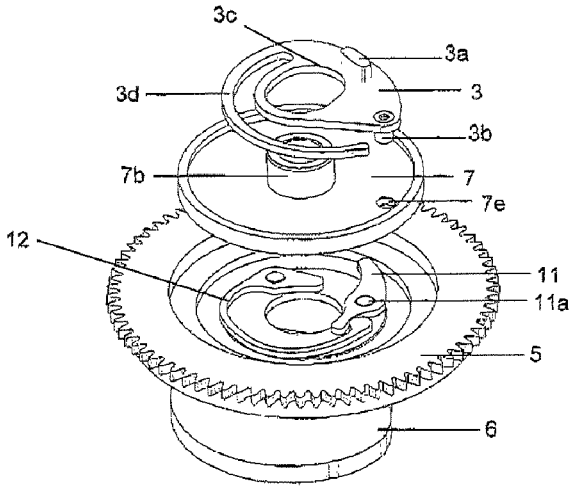
FIG. 3 is an exploded view in perspective of FIG. 2.

The tooth 1*a* of the calendar indicator disk 1 is driven every 24 hours in this example by a finger 3*a* of an instantaneous-jump drive mechanism, illustrated in particular by FIGS. 1A, 2 and 3, notably by a side 3*a*' of the finger.

This mechanism comprises a 24-hour wheel 5 which is engaged with the hours wheel (or cannon wheel, not shown) of the timing gear train of the timepiece. The gear ratio being 2:1 between the 24-hour wheel 5 and the hours wheel, the 24-hour wheel 5 makes one revolution in 24 hours. This wheel pivots freely about a segment 7*c* of a tubular core 7 mounted so as to pivot on a pivot secured to the frame of the timepiece.

The tubular core 7 comprises a dish 7*a* in which a drive component 3 is mounted so as to pivot with the aid of a pivot 3*b* engaged in a circular opening 7*e* made in the bottom of the dish 7*a*. This pivot 3*b* protrudes beneath the dish 7*a*, into a circular recess 5*a* made in the 24-hour wheel 5, a recess in which a snap-fitting component 11 is mounted so as to pivot with the aid of a pivot 11*a*. A spring 12, resting against one end of the snap-fitting component 11, tends to keep the opposite end of this snap-fitting component 11 against the side wall of the circular recess 5*a*. This snap-fitting component 11 serves as a one-way drive component between the 24-hour wheel 5 and the drive component 3.

The latter supports a drive finger 3*a* which protrudes on its surface in order to engage with the tooth 1*a* of the calendar indicator disk or ring 1. This drive component comprises a spring 3*d* of which the free end rests against the side wall of the dish 7*a*. This spring tends to rotate the drive component 3 in the clockwise direction about the pivot 3*b*. This rotation is restricted by one of the ends of an elongate opening 3*c* which butts against the portion 7*b* of the core 7.

The tubular core 7 also comprises a segment 7*d* of reduced diameter relative to the segment 7*c* on which the 24-hour wheel pivots and which extends beneath this 24-hour wheel 5. An instantaneous-jump cam 6 is chased onto the segment 7*d* of the tubular core 7 and rests against the bearing surface made between the segment 7*d* and the segment 7*c*.

The instantaneous-jump cam 6 is engaged with a roller 8*a* supported by a lever 8 which is pressed against the cam 6 by a spring 9. This cam 6 comprises a winding curve 6*a*, an instantaneous-jump curve 6*b* and a concave stop curve 6*c*. The intersection between the two curves 6*a* and 6*b* determines the exact moment when the lever 8 acted upon by the spring 9 will cause the roller 8*a* to pass suddenly from this intersection to the stop curve 6*c*.

Figure 4:
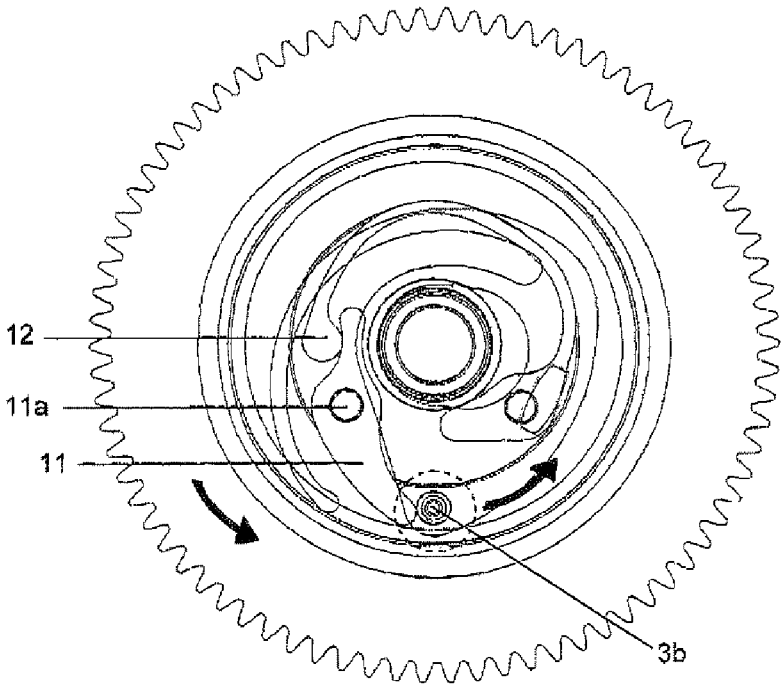
FIGS. 4 and 5 are partial plan views along IV-IV of FIG. 2, illustrating the device of this FIG. 2 in driving and respectively nondriving positions.
Figure 5:
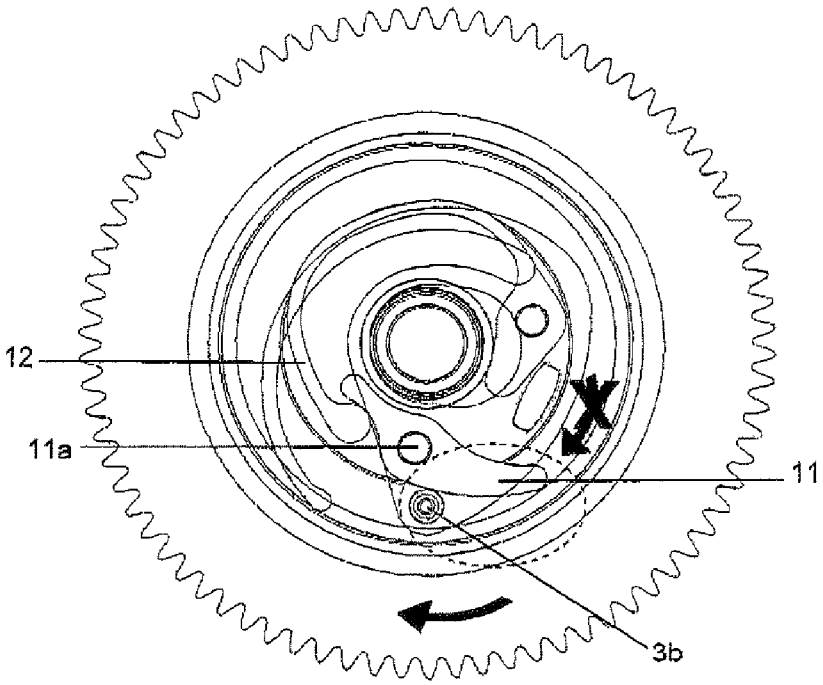

The device described above works in the following manner:

In normal operation, the 24-hour wheel 5 rotates in the direction of the arrow in FIG. 4. The snap-fitting component 11 is in the position illustrated in this figure. Its end opposite to that which is engaged with the spring 12 presses simultaneously against the side wall of the space 5*a* in the 24-hour wheel 5 and against the pivot 3*b* of the drive component 3. Consequently, all the elements 3, 6 and 7 are driven by the 24-hour wheel 5 until the roller 8*a* of the lever reaches the junction of the curves 6*a*, 6*b* of the instantaneous-jump cam 6.

Figure 6:
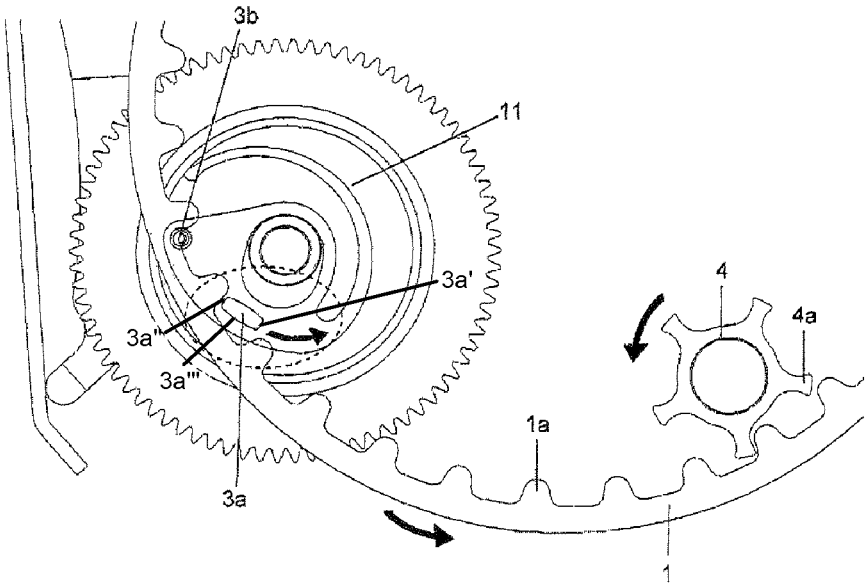
FIG. 6 is a plan view of the display device illustrating a correction in the direction of the increasing time period display.

At this moment, the cam 6, the tubular core 7 and the drive component 3 are driven by the energy stored during the winding of the spring 9, from the junction of the curves 6*a*, 6*b* until the roller 8*a* reaches the stop curve 6*c*. During this sudden movement of these elements, the side 3*a*' of the finger 3*a* drives by one step the calendar indicator disk 1. FIG. 6 illustrates the position of the display device just after the jump of a day of the month by the drive finger 3*a*. Note that the pivot 3*b* of the drive component has been separated from the snap-fitting component 11 and that the drive finger 3*a* remains between two teeth 1*a* of the calendar indicator disk. Thus, the side 3*a*" of the finger 3*a* serves as an abutment against the calendar indicator disk, which ensures that this disk cannot be moved by more than one step by instantaneous jump caused every 24 hours by the drive component 3.

Suppose that, at this precise moment when the finger 3*a* is between two teeth 1*a*, the user of the watch tries to set the time by turning the hands in the direction opposite to their usual direction. The hours wheel (not shown) which drives the 24-hour wheel will cause the latter to turn in the direction indicated by the arrow in FIG. 5. In this direction, the snap-fitting component 11 tips in the counterclockwise direction when it meets the pivot 3*b*. The drive component 3 and the cam 6 are therefore not driven, the positioning of the finger 3*a* relative to the teeth 1*a* is therefore not changed, and this rotation of the hands of the watch can be carried out without posing a malfunction, blockage or breakage problem.

If, in the same position of the drive finger 3*a*, the rapid correction mobile 4 is driven manually in the direction of the arrow in FIG. 6, it drives the tooth 1*a* of the calendar indicator disk 1 in the direction of increasing calendar indicator display. Since the drive component 3 is separated from the 24-hour wheel 5 when the side 3*a*" of the finger 3*a* is driven by the tooth 1*a* moving in the direction of increasing calendar indicator display, the lever 8 engaged with the cam 6 will return the roller 8*a* into the hollow of the concave stop curve 6*c* of the cam 6 after each passage of a tooth 1*a* and will consequently return the finger 3*a* into the position of FIG. 6. The rapid correction in the increasing calendar indicator direction therefore poses no problem.

Figure 7:
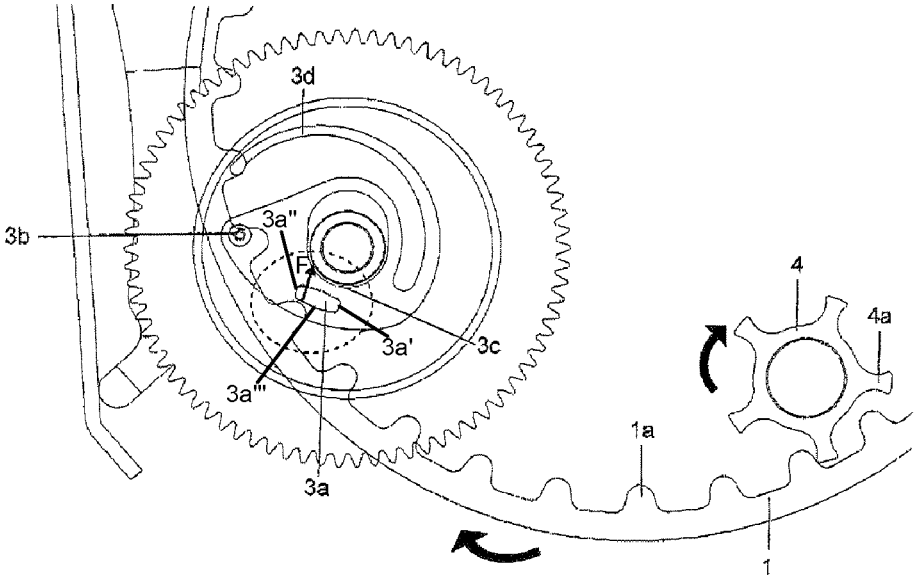
FIG. 7 is a plan view of the display device illustrating a correction in the direction of decreasing time period display.

Let us now examine the situation in the case of a rapid correction made via the correction mobile 4 in order to turn the calendar indicator disk 1 in the decreasing direction of calendar indicator display, as illustrated in FIG. 7. By reversing the calendar indicator disk 1, in the direction indicated by the arrow in FIG. 7, a tooth 1*a* meets the side 3*a*'" of the finger 3*a* which is between two teeth 1*a*. The force that this tooth 1*a* exerts on the side 3*a*'" of the finger 3*a* in the direction indicated by the arrow F makes it possible to pivot the drive component about the pivot 3*b*, by virtue of the elongate opening 3*c*. By pivoting in the counterclockwise direction about the pivot 3*b*, the drive component 3 compresses the spring 3*d*. When the tooth 1*a* releases the finger 3*a*, the spring 3*d* pivots the component 3 about the pivot 3*b* in the clockwise direction. This pivoting of the component 3 in both directions is restricted by the opening 3*c* and the finger 3*a* returns to the position that it occupied before the rapid correction in the decreasing direction of calendar indicator. A setting of the time carried out by causing the hands to rotate in the direction that is the reverse of their usual direction has no impact on the positioning of the finger 3*a* relative to the teeth 1*a*, such that a tooth 1*a* continually meets the side 3*a*''' of the finger 3*a* when the calendar indicator disk moves in the direction of decreasing display of the calendar indicator. Thus, the orientation of the force that one of the teeth 1*a* exerts on the finger 3*a* is perfectly defined by the side 3*a*''' in order to allow the finger 3*a* to rotate about the pivot 3*b*. The risk of blockage between one of the teeth 1*a* and the finger 3*a* during a rapid correction of the date in the reverse direction of the date is therefore removed.

It is therefore noted that the finger 3*a* has a side 3*a*' that is dedicated solely to the driving of one step of the calendar indicator disk in order to allow the instantaneous transition of the date. It is also noted that the finger 3*a* is furnished with a side 3*a*''' which is formed so as to prevent any contact between one of the teeth 1*a* and the side 3*a*' when the calendar indicator disk is moved in the direction of decreasing display of the calendar indicator. Thus, during the rapid correction of the date in the direction of reversing the date, the orientation of the force F that one of the teeth 1*a* exerts on the finger 3*a* can in no circumstances be defined by the side 3*a*' and can therefore in no circumstances pass through the pivot 3*b*. The risk of blockage between the calendar indicator disk and the finger 3*a* is therefore removed.

Figure 8:
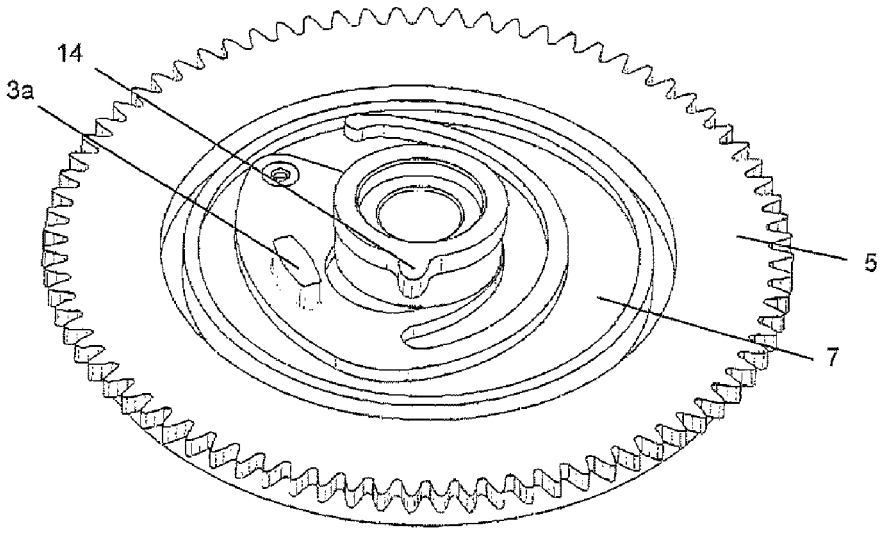
FIG. 8 is a view in perspective of a variant of the device according to the invention for a device for displaying an annual calendar described in EP 1 596 261 B1.
Figure 9:
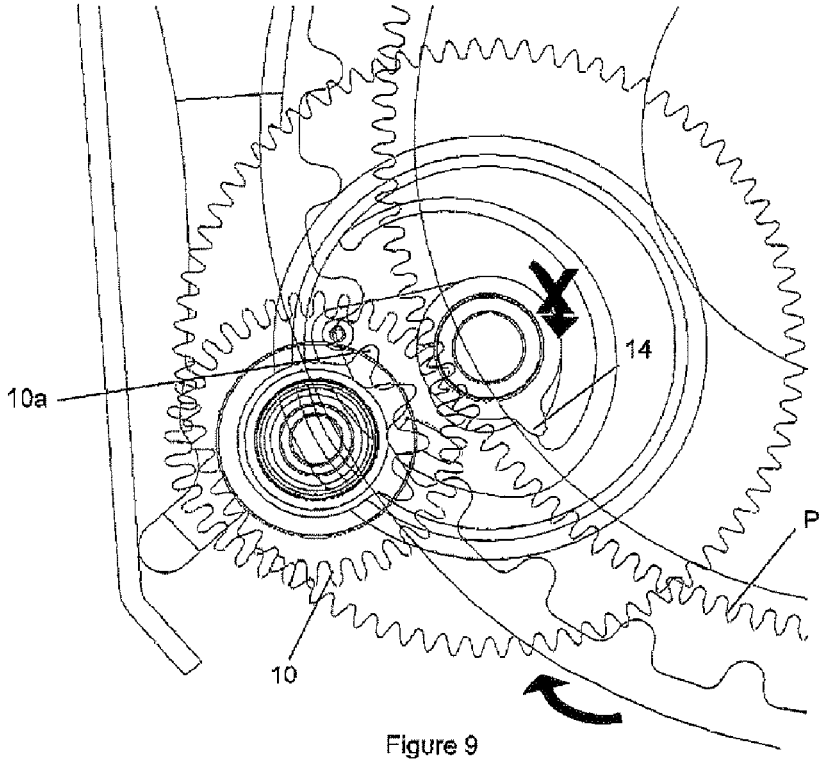
FIG. 9 is a plan view of this device for displaying annual calendars, modified according to FIG. 8 to make it possible to prevent the blockage when there is a rapid correction in the direction of decreasing time period display.

FIGS. 8 and 9 relate to a variant of the embodiment described above, applied to an annual calendar as described in EP 1 596 261. As described in this document, in this variant, the calendar indicator disk or ring 1 carries a tumbler 10 meshing with a planetary mobile P. The tumbler is furnished with a four-tooth pinion 10*a* corresponding to the four months of the year containing 30 days, which meshes with the fixed planetary tooth gear. The tooth gear ratios of the tumbler 10 and of the planetary mobile P are chosen so that, at the end of each 30-day month, one of the teeth of the pinion 10*a* is situated in the trajectory of an additional finger 14 secured to the tubular core 7 and therefore to the cam 6.

The additional finger 14 is offset angularly relative to the finger 3*a* of the drive component 3. During the instantaneous jump of the cam 6 under the pressure of the spring 9 transmitted by the lever 8 and the roller 8*a*, because of the angular offset between the fingers 3*a* and 14, it is the finger 14 that first meets one of the teeth 10*a* of the tumbler 10 and moves the calendar indicator ring by one step, causing it to pass from the 30th to the 31st then, during the same instantaneous jump of the cam 6, the finger 3*a* takes over and drives a tooth 1*a* of the calendar indicator ring 1 by a second step causing it to pass from the 31st to the 1st. Thus, during the same instantaneous jump of the cam 6, the calendar indicator ring moves from the 30th to the 1st.

As in the mechanism described in EP 1 596 261, the finger 3*a* and the finger 14 are both secured to the instantaneous-jump cam 6. On the other hand, in the mechanism that is the subject of the invention, the finger 3*a* is secured to the drive component 3, while the finger 14 is not. If, when the components of the display mechanism are situated in the position illustrated by FIG. 9, the rapid date setting is actuated in the reverse direction of the calendar indicator, a tooth 1*a* of the calendar indicator disk or ring 1 which moves in the direction of the arrow under the action of the rapid correction mobile 4 meets the finger 3*a* and moves it away exactly as in the case of FIG. 7. Thus, there is no risk of blockage between the tooth 10*a* and the finger 14 whether or not a time setting in the anticlockwise direction is carried out beforehand.

This same principle can be used for the driving of a days of the week indicator or in a jumping hours display device. In all cases, the adaptation of the drive component to such display devices makes it possible to make a rapid correction in both correction directions or a simple time setting, or even both, with no risk of blockage or of breakage of this device.

In the first embodiment described above, a snap-fitting component 11 was described which is used as a one-way drive component between the 24-hour wheel 5 and the drive component 3. Moreover, this drive component comprises a finger 3*a*, an elongate opening 3*c*, an off-center pivot 3*b* and a spring 3*d* in order to allow, in certain cases, the finger 3*a* to retract from the tooth 1*a* of the days of the week ring 1 during a correction made just after the change of date, when the finger is still engaged with the tooth 1*a*.

It may also be advantageous to use a mobile which associates a one-way connection device with a rigid drive finger. The latter makes it possible to remove all the periods of rapid noncorrection of the hour indication in the increasing hour indication direction, and makes it possible, in certain situations, to advantageously replace the elastic drive finger 3*a* associated with a driving mobile which allows it to be driven two ways under the effect of a time setting.

Figure 10:
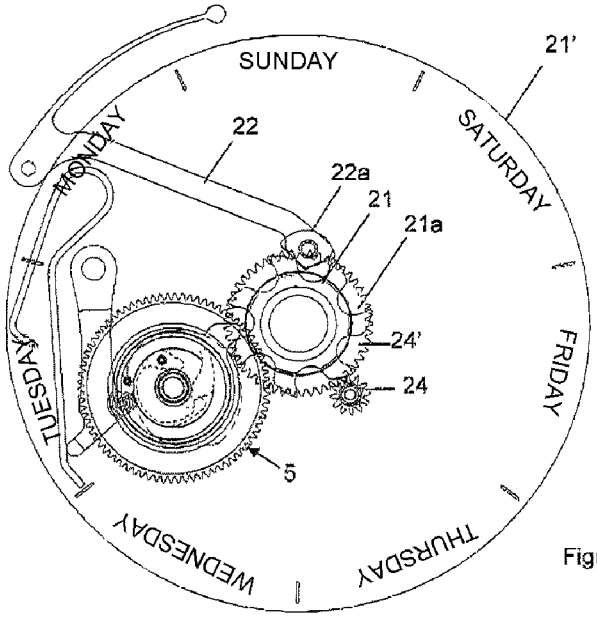
FIG. 10 is a plan view of a second embodiment.
Figure 11:
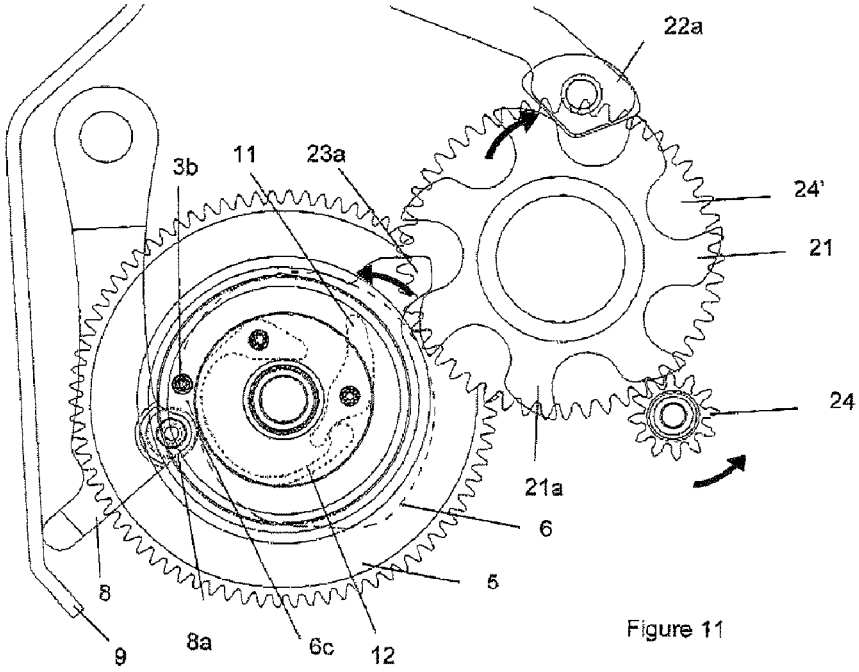
FIG. 11 is an enlarged partial view of FIG. 10.

The second embodiment illustrated by FIGS. 10 and 11 relates to the days of the week display. This embodiment comprises a star 21 with seven teeth 21*a*. This star 21 supports the days display disk 21'. The tooth 21*a* of this star 21 is indexed angularly by a nose 22*a* situated at the end of a jumper 22 and is driven instantaneously every 24 hours at midnight, by the hours wheel 5, as in the case of the first embodiment.

This device comprises a rapid correction mechanism comprising a corrector pinion 24 driven only in the direction of the arrow that is attached to it in FIG. 11, by a known mechanism that it is not necessary to be familiar with to understand the invention, and a correction wheel 24' secured to the star 21. Thus the days indication can be corrected only in the increasing direction of the days.

After the jump of the star 21 caused, as in the first embodiment, by the lever 8, the spring 9 and the cam 6, the driving finger 23*a* is in the position illustrated by FIGS. 10 and 11. The finger 23*a* thus positioned makes it possible to prevent any risk of double jumping of the days display disk 21'.

An elastic drive finger, like those of the prior art, which would retract under the effect of the rotation of the star 21, but which would be associated with a two-way drive, cannot be used to solve the problem of rapid correction preceded by the time setting in the counterclockwise direction that would be carried out just after the date jump. Specifically, such a correction would be capable of generating too high stresses of the spring leaf, associated with such an elastic finger, because of the angular pitch of the star 21 which corresponds to approximately 52°, while it is only approximately 11.6° in the case of the calendar indicator disk.

This is why the one-way drive, as described in the second embodiment, can be used on its own to solve this problem. In this case, the drive finger 23*a* can therefore be fixed. By virtue of this embodiment, the principle of locking the days display disk 21 after the date jump is retained in order to prevent any double jump. As illustrated by FIG. 11, after the date jump, the finger 23*a* is still held in the tooth 21*a*. The correction is made possible because of the one-way connection between the drive finger 23*a* and the drive mobile 5, formed of the pivot 3*b*, of the snap-fitting component 11 and of the spring 12, as in the first embodiment.

If the corrector pinion 24 rotates the star 21 in the direction of increasing display of days of the week, a tooth 21*a* drives the finger 23*a* which is separated from the hours wheel 5 because of the one-way connection.

After each passage of a tooth 21*a*, the finger 23*a* is returned to its initial position, illustrated by FIG. 11, by the lever 8 pressed by the spring 9 which returns the roller 8*a* into the hollow 6*c* of the cam 6.

"Means of correction to come into direct engagement with the indicator component" or "means of correction coming into direct engagement with the indicator component" mean notably means making it possible to move the indicator component by applying an action that does not pass through the 24-hour wheel.

The invention claimed is:

1. A device for displaying determined time periods comprising a display element (A) for displaying said time periods, an indicator component (1) mounted so as to be able to move relative to said display element (A), a drive component (3) furnished with a drive finger (3*a*) for driving the indicator component (1), a cam (6) comprising a progressive winding phase and an instantaneous unwinding phase of a spring (9), this cam (6) being engaged with said drive component (3), a drive mobile (5) for driving said cam (6) in a cycle corresponding to that of said time periods and correction means (4) for coming into direct engagement with said indicator component (1), characterized in that a one-way connection device (3*b*, 11, 12) connects said drive mobile (5) to said cam (6).

2. The display device as claimed in claim 1, wherein said drive component (3) is engaged with said cam (6) by elastic return means (3*d*) and guidance means (3*b*) defining a degree of freedom of said drive component (3) in order to allow said indicator component (1) to move the drive component (3) against said elastic return means (3*d*) when the latter occupies a position interfering with the movement of said indicator component (1) by said correction means (4).

3. The display device as claimed in claim 2, wherein said drive component (3), said elastic return means (3*d*) and guidance means (3*b*, 3*c*) form a single component.

4. The display device as claimed in claim 2, wherein said guidance means (3*b*) for guiding said drive component (3) comprise a pivot (3*b*) engaged in a circular opening (7*e*) made in the bottom of a dish (7*a*) secured to said cam (6), this pivot (3*b*) protruding into a circular recess (5*a*) made in said drive mobile (5), said one-way connection device (3*b*, 11, 12) comprising a snap-fitting device (11, 12) secured to said drive mobile (5) and mounted in said circular recess (5*a*) so as to come into engagement with the portion of said pivot (3*b*) protruding into the recess (5*a*) only in one direction of rotation of said drive mobile (5).

5. The display device as claimed in claim 3, wherein said guidance means (3*b*) for guiding said drive component (3) comprise a pivot (3*b*) engaged in a circular opening (7*e*) made in the bottom of a dish (7*a*) secured to said cam (6), this pivot (3*b*) protruding into a circular recess (5*a*) made in said drive mobile (5), said one-way connection device (3*b*, 11, 12) comprising a snap-fitting device (11, 12) secured to said drive mobile (5) and mounted in said circular recess (5*a*) so as to come into engagement with the portion of said pivot (3*b*) protruding into the recess (5*a*) only in one direction of rotation of said drive mobile (5).

6. The display device as claimed in claim 4, wherein the edge of said dish (7*a*) secured to said cam (6) serves as a bearing surface for said elastic return means (3*d*) of said drive component (3).

7. The display device as claimed in claim 5, wherein the edge of said dish (7*a*) secured to said cam (6) serves as a bearing surface for said elastic return means (3*d*) of said drive component (3).

8. The display device as claimed in claim 1, wherein said display device is that of an annual calendar of which said indicator component carries a tumbler mobile (10) meshing with a planetary mobile (P) and carrying a pinion (10*a*) the teeth of which correspond to the 30-day months of the year, an additional finger (14) being secured to said instantaneous-jump cam (6), but offset angularly relative to the finger (3*a*) of the drive component (3), the tooth gear ratio between the tumbler (10) and the planetary mobile being chosen to place one of the teeth of the pinion (10*a*) in the trajectory of the additional finger at the time of the instantaneous jump of said cam (6).

9. The display device as claimed in claim 1, wherein said correction means (4, 24) are rapid correction means not using the timing gear train.

10. A timepiece, notably a watch, furnished with a display device as claimed in claim 1.

* * * * *